United States Patent [19]

Bowen et al.

[11] 4,434,343

[45] Feb. 28, 1984

[54] TURNTABLE FOR MICROWAVE OVEN

[75] Inventors: Robert F. Bowen, Burlington; Thomas J. Martel, North Reading, both of Mass.

[73] Assignee: Raytheon Company, Lexington, Mass.

[21] Appl. No.: 339,579

[22] Filed: Jan. 15, 1982

[51] Int. Cl.[3] ..... H05B 6/80; A47B 11/00

[52] U.S. Cl. ..... 219/10.55 F; 219/10.55 E; 219/10.55 D; 108/20; 108/139; 99/443 R; 126/338

[58] Field of Search ..... 219/10.55 F, 10.55 R, 219/10.55 B, 10.55 E, 10.55 D, 389; 99/448, 444–446, 443 R, 451, DIG. 14; 126/338, 182, 41 A; 108/20, 139, 142

[56] References Cited

U.S. PATENT DOCUMENTS

| | | | |
|---|---|---|---|
| 4,140,889 | 2/1979 | Mason, Jr. et al. | 219/10.55 E |
| 4,216,727 | 8/1980 | Cunningham | 108/139 X |
| 4,219,715 | 8/1980 | Mandle et al. | 219/10.55 E X |
| 4,254,319 | 3/1981 | Beh et al. | 219/10.55 F |
| 4,258,630 | 3/1981 | Jorgensen et al. | 108/20 |
| 4,283,614 | 8/1981 | Tanaka et al. | 219/10.55 B X |
| 4,330,696 | 5/1982 | Pomeroy et al. | 219/10.55 E |
| 4,337,384 | 6/1982 | Tanaka et al. | 219/10.55 B |

*Primary Examiner*—B. A. Reynolds
*Assistant Examiner*—Philip H. Leung
*Attorney, Agent, or Firm*—William R. Clark; Joseph D. Pannone

[57] ABSTRACT

A two level turntable adapted for use in a microwave oven. The top level platform which may include a roasting rack is removably supported above the bottom level by a plurality of columns. The bottom level platform has a shaft that extends downwardly through an aperture in a microwave shielding enclosure to a motor. The motor components consisting of a coil spring and a braking mechanism are mounted in substantially the same horizontal plane to provide a relatively low vertical profile. Although the low profile is important when the bottom level platform is used by itself, it is even more important when the top level platform is mounted on top. The shielding enclosure which includes a pan shaped bottom has a downwardly bent lip from the lid to provide a low microwave field region adjacent to the connection of the pan and lid.

5 Claims, 8 Drawing Figures

FIG. 3
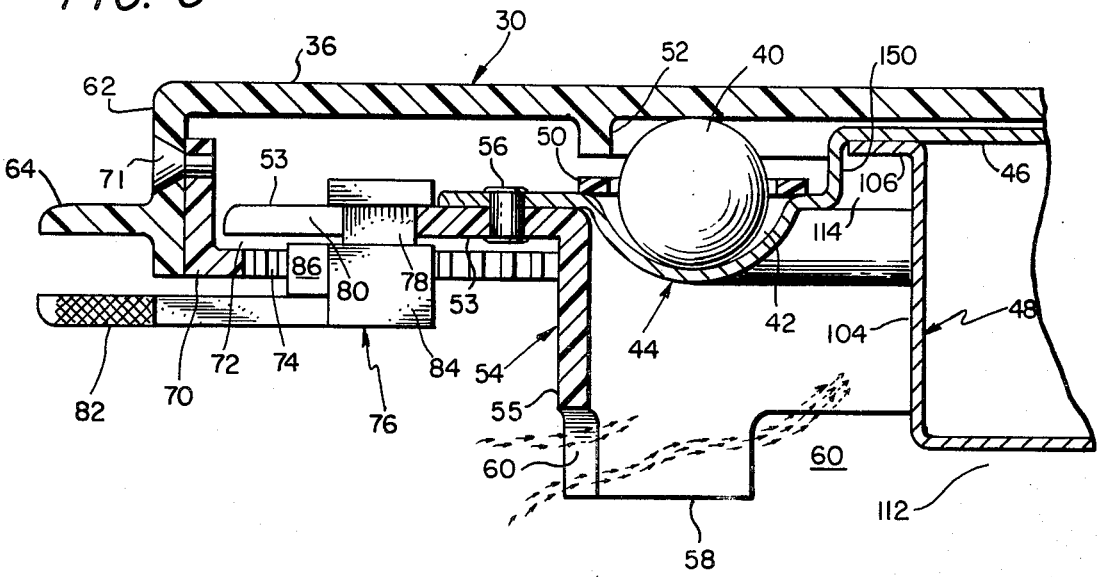
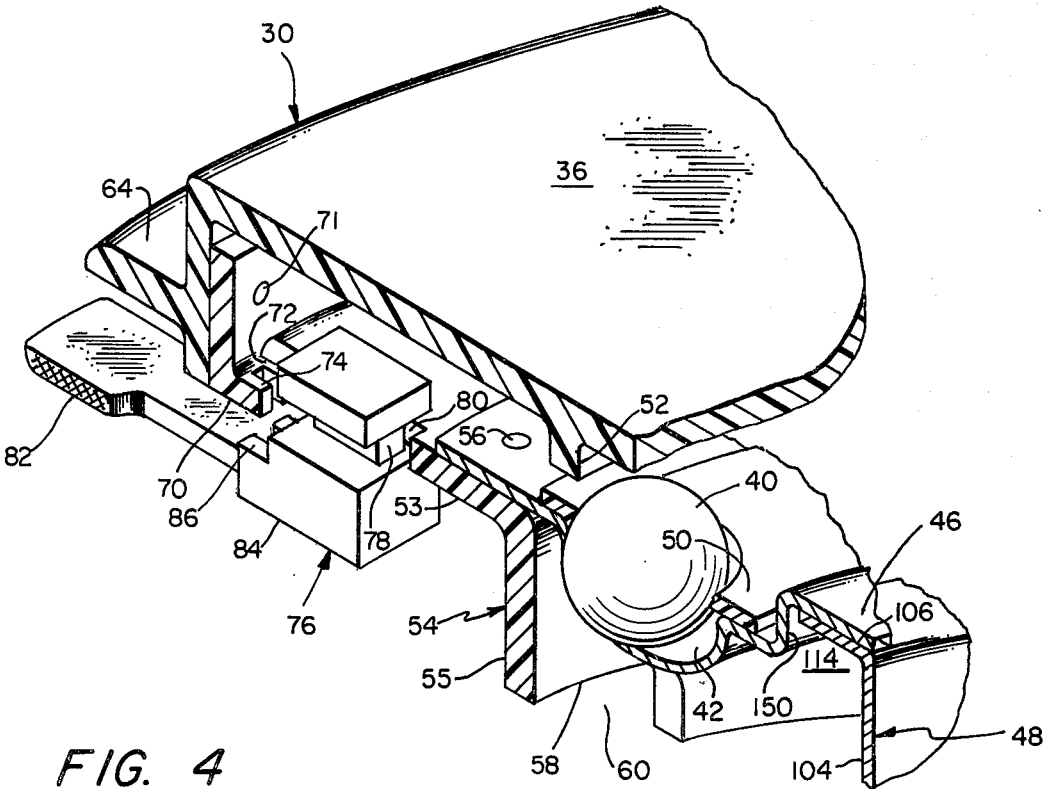
FIG. 4

FIG. 7
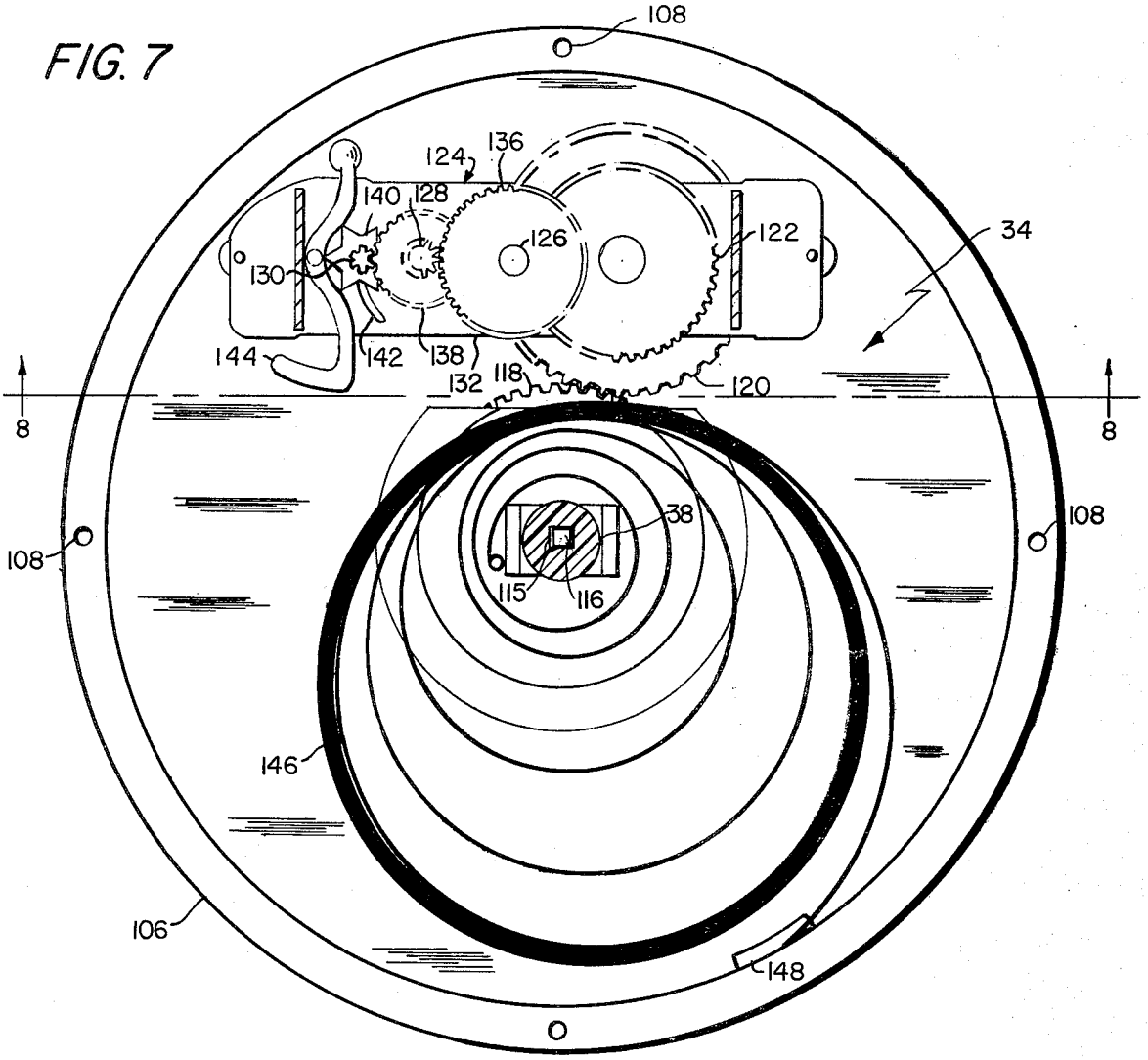
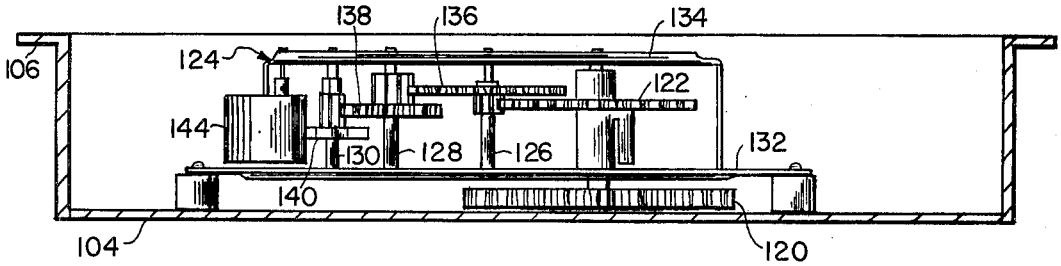
FIG. 8

TURNTABLE FOR MICROWAVE OVEN

BACKGROUND OF THE INVENTION

It is well known that microwave energy propagated into a conductive cavity sets up a complex standing wave which is characterized by a large number of "cold" and "hot" spots. Early development microwave ovens accordingly exhibited very nonuniform heating.

Through the years, significant advances have been made in pattern uniformity. The first important step was the use of a mode stirrer which is merely a moving conductive device which alters the standing wave pattern. Later, rotating directive microwave radiators provided increased uniformity. However, even with these improved feed structures, it still may be desirable to stop the oven at some point during the cooking cycle and physically move the food within the cavity.

Another prior art attempt to improve heating uniformity was the introduction of a support surface in the oven cavity which moved. The common approach was to have a rotating turntable. Next, a portable turntable was introduced to the market place; it is described in U.S. Pat. No. 4,258,630 issued Mar. 31, 1981. However, there are still significant disadvantages. For example, the described portable turntable has a relatively high profile which substantially reduces the available cooking space in a microwave oven cavity. Also, the rotating surface area is limited because there is only one food support surface. Further, the relatively high profile would be even more disadvantageous if there were a second level.

SUMMARY OF THE INVENTION

The invention discloses a turntable which is adapted for use in a microwave oven to provide uniform food heating by rotation, comprising a microwave transparent platform for supporting food, the platform having a shaft extending downwardly from the middle of the underside thereof, means for rotating the platform about the axis of the shaft, the rotating means comprising a coil spring and a braking mechanism positioned in substantially the same horizontal plane thereby minimizing the vertical height of the rotating means, a metal housing for shielding the rotating means from microwave energy wherein the housing has an aperture in the top, and the shaft of the platform extending through the aperture into the housing for connecting the platform to the rotating means. It may be preferable that the platform defines a substantially circular disk. Also, it may be preferable that the metal housing comprises a pan shaped member and a lid having an over-extending lip providing an annular trough for supporting spherical bearings on which the platform rests. The food may be positioned directly on the platform or be contained in a cooking utensil which is positioned on the platform. The shaft may preferably have a diameter of less than one-half inch so that the aperture may be small enough so as to prevent the coupling of microwave energy therethrough. The microwave energy may have a frequency of 2450 megahertz. The braking mechanism, which also may be referred to as a timing gear, typically comprises a plurality of pinioned gears engaged to a star gear which is coupled to an idler. The vertical height may preferably be less than two inches.

The invention may also be practiced by a turntable comprising a microwave transparent platform having a shaft extending downwardly from the middle of the underside, means for rotating the platform about the axis of the shaft, means for shielding the rotating means from microwave energy, the shielding means comprising a metal pan having a metal cover with an aperture therein, the cover extending outwardly from the side wall of the pan to form a lip wherein the lip extends outwardly for a distance and then downwardly to provide a low microwave field region between the side of the pan and the downward region of the lip, the lip further having an annular trough with spherical bearings therein, an annular keeper positioned over the trough for maintaining substantially equal spacings between the bearings, the platform being supported by the bearings, and the shaft extending through the aperture for coupling to the rotating means. The bearings and keeper preferably comprise microwave transparent material. Also, there may be a protrusion from the underside of the platform adjacent to the keeper for preventing the keeper from riding upwardly on the bearings. The keeper may define an annular band having holes therein in which the bearings are positioned. The outward distance that the lip extends before bending downwardly may be approximately 0.5 inches.

The invention teaches a turntable comprising a microwave transparent platform having a shaft extending downwardly from the middle of the underside, means for rotating the platform about the axis of the shaft, means for shielding the rotating means from microwave energy wherein the shielding means comprises a metal enclosure with a top surface having an aperture, a microwave transparent base for supporting the shielding means, the base having a plurality of legs with an open bottom and spaces between the legs for permitting air to circulate under the base and the shielding means, and the shaft of the turntable being coupled through the aperture for connecting to the rotating means.

Finally, the invention may also be practiced by a multiple level turntable comprising a first microwave transparent platform for supporting food, the first platform having a shaft extending downwardly from the middle of the underside, means for rotating the first platform about the axis of its shaft, means for shielding the rotating means from microwave energy, and a second microwave transparent platform elevated above the first platform and coupled thereto by a plurality of support columns wherein rotation of the first platform in the horizontal plane imparts rotation to the second platform. It may be preferable that the second platform comprise a plurality of raised ribs for supporting food above drainage channels which slope downwardly to a trough in which the drippings may collect. Stated differently, the second platform may define a microwave roasting rack. It is preferable that the second platform be removable from the first platform so that either may be used as a single unit. When the second platform is used by itself in an elevated position, there is a space underneath the platform to cook other food.

BRIEF DESCRIPTION OF THE DRAWINGS

The foregoing will be more easily understood by reading a description of the preferred embodiment with reference to the drawings wherein:

FIG. 3 is a sectioned elevation view of the outer region of the lower portion of the turntable;

FIG. 4 is an isometric projection view of the apparatus shown in FIG. 3;

FIG. 7 is a top view of the motor in the pan as taken along line 7—7 of FIG. 8; and FIG. 8 is an elevation view of the motor in the pan.

DESCRIPTION OF THE PREFERRED EMBODIMENT

Figure 1:
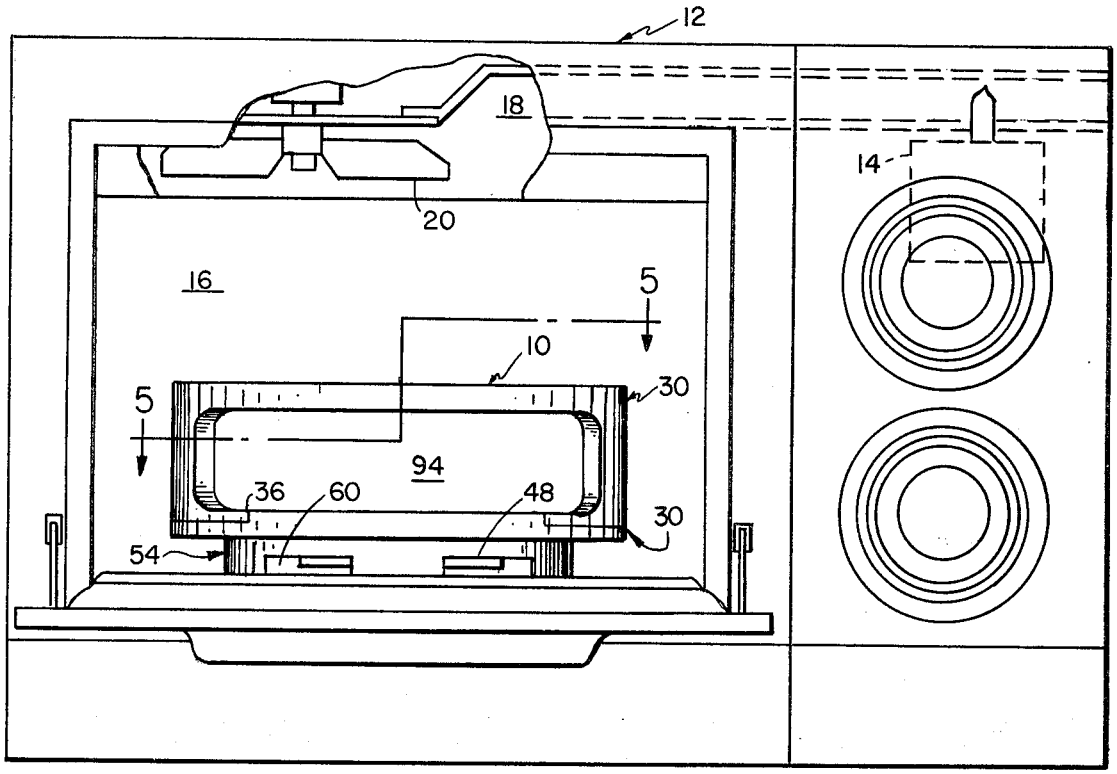
FIG. 1 is a microwave turntable positioned in a microwave oven.

Referring to FIG. 1, there is shown a microwave oven turntable 10 embodying the invention. Turntable 10 is shown positioned in a conventional microwave oven 12. Microwave energy typically having a frequency of 2450 MHz is provided by magnetron 14 and coupled to cavity 16 by suitable apparatus such as, for example, through waveguide 18 and past mode stirrer 20. More preferably, a primary radiator (not shown) may be used to couple a directive radiation pattern into cavity 16. Other conventional microwave oven parts and features such as, for example, the door and door seal are not described in detail as they are well known in the art and form no part of the invention.

Figure 2:
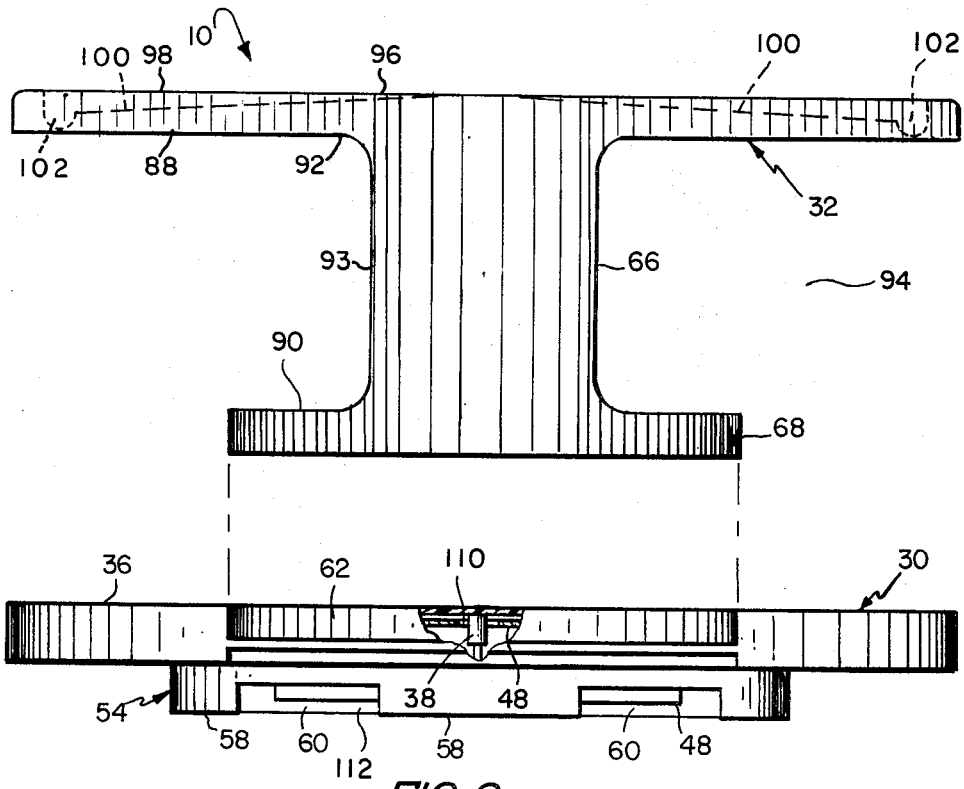
FIG. 2 is an end elevation view of the turntable of FIG. 1 with the top platform separated from the bottom platform.
Figure 5:
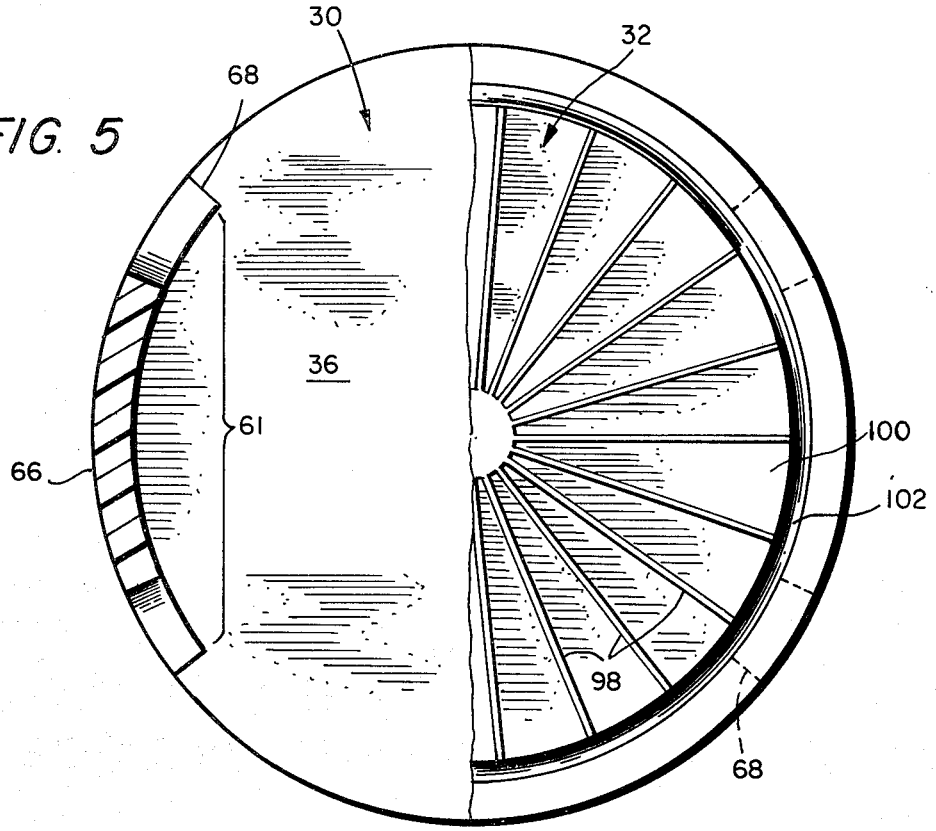
FIG. 5 is a view taken along line 5—5 of FIG. 1.
Figure 6:
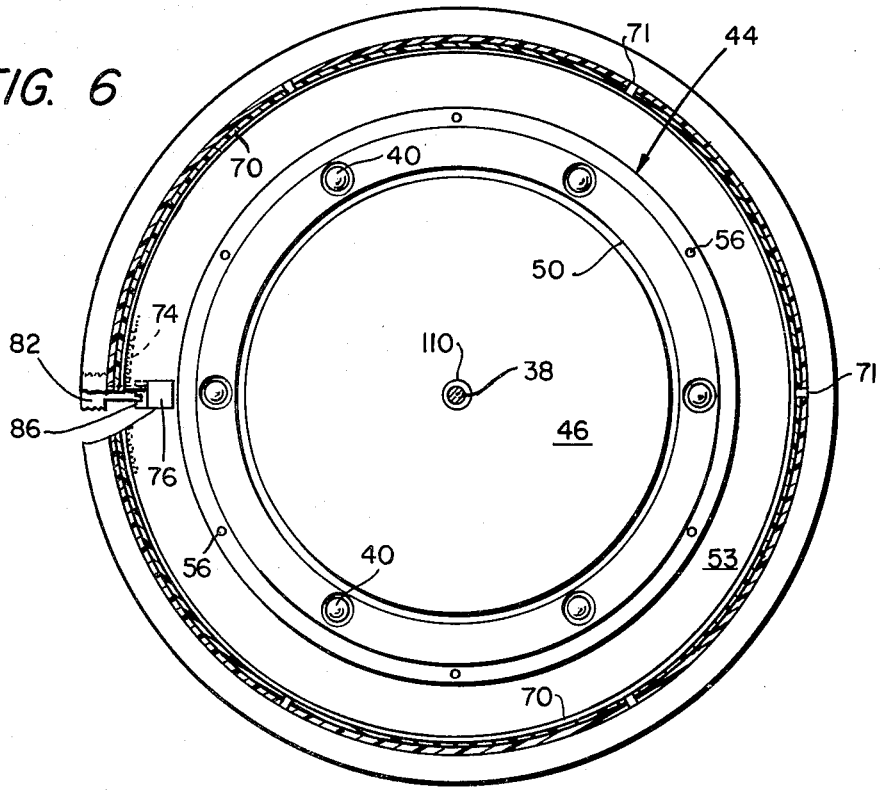
FIG. 6 is a partially cut away top view of the lower portion of the turntable with the top surface of the lower platform removed.

Referring to FIG. 2, a partially cut away side elevation view of turntable 10 is shown. FIG. 3 is a sectioned elevation view of the peripheral region of the lower portion of the turntable and FIG. 4 is a isometric projection view of FIG. 3. FIG. 5 is taken along line 5—5 of FIG. 1. FIG. 6 is a partially cut away top view with bottom platform 30 removed. Like numerals refer to the same parts of the several drawings. Food and/or cooking utensils may be positioned on either or both bottom platform 30 or top platform 32. Bottom platform 30 is fabricated from a microwave transparent or low loss material. Preferably, the material is also resistant to temperatures on the order of 500° or 600° F. because, in operation, it may be desirable to place heat producing microwave cooking utensils on platform 30. It is also preferable that the material exhibit impact resistant properties. Support surface 36 of bottom platform 30 which is substantially flat and circular functions to support food or utensils. Shaft 38 which is an integral part of bottom platform 30 is connected to motor 34 which provides the drive for platform rotation.

Other than the stability provided by the connection of shaft 38 to motor 34, bottom platform 30 is supported in the horizontal plane by bearings 40. As shown in FIG. 6, six bearings are evenly spaced around annular groove 42 which is formed in extension 44 from lid 46 of motor housing 48. It is apparent to those skilled in the art that a different number bearings 40 could be used. The bearings are held in the evenly spaced distribution around groove 42 by keeper 50. Bearings 40 are made of a microwave transparent or low loss material such as, for example, glass. Keeper 50 is also fabricated of a microwave transparent material such as, for example, polysulfone. Bottom platform 30 has protrusion 52 on the under side which functions as a retainer to prevent keeper 50 from riding upwards. Protrusion 52 may be in the form of an annular band or a plurality of posts around the under side of bottom platform 30 adjacent to keeper 50.

Extension 44 of lid 46 is rigidly connected to a horizontal section 53 of base 54 by rivets 56 or like connector at a plurality of points around the peripheral region of extension 44. Vertical section 55 of base 54 has a plurality of legs 58 with openings 60 therebetween to provide for the flow of convection air underneath turntable 10 to prevent overheating. The flow of air is indicated by arrows and may result from natural heat convection or forced blower air as provided for in most microwave ovens. Base 54 is fabricated from a microwave transparent or low loss material.

From opposing arcs 61 on the outer perimeter of support surface 36, the outer edge 62 descends to ledges 64. These ledges provide mounting structures for elongated columns 66 of top platform 32. Also, ledges 64 may function as handles for picking up turntable 10. At the ends of the arcs, support surface 36 continues outwardly and abuts the ends 68 of elongated columns 66 when top platform 32 is positioned over bottom platform 30. Accordingly, top platform 32 may be securely engaged to bottom platform in the horizontal plane such that rotation of bottom platform 30 imparts rotation on top platform 32.

Inwardly directed flange 70 extends underneath a peripheral band of horizontal section 53 of base 54. Flange 70 may preferably be a separate part which is connected to bottom platform 30 by raising it into position and then securing it to bottom platform 30 using a plurality of rivets 71 or like connector around its circumference. Flange 70 being underneath a band of horizontal section 53 of base 54 couples bottom platform 30 to base 54 so as to form a single unit. Accordingly, if bottom platform 30 is picked up, base 54 rises with it. In operation, however, there is a small separation 72 between the bottom of the overlap peripheral band of base 54 and flange 70 such that bottom platform 30 will rotate while base 54 remains stationary.

Teeth 74 are provided in the inner circumference of flange 70 so that even though the motor is activated, rotation of bottom platform 30 can be prevented. Sliding lock 76 which is made of microwave transparent material has a narrow neck 78 which is engaged in radial slot 80 in the peripheral region of horizontal section 53 of base 54. Lock 76 may be slid inwardly and outwardly in the slot by handle 82 which extends outwardly past the edge 62 of bottom platform 30. The shoulder 84 of lock 76 below slot 80 has teeth 86 which engage teeth 74 when sliding lock 76 is pulled by handle 82 to its outward position in slot 80; this outward position of lock 76 prevents rotation of bottom platform 30.

As described briefly heretofor, top platform 32 has columns 66 which elevate the bottom surface 88 of top platform 32 approximately three inches above support surface 36. Turntable 10 can be operated as a single level unit with top platform 32 removed. However, when top platform 32 is mounted above bottom platform 30 on ledges 64, two cooking support levels are available so that more than one food item can be cooked simultaneously. Columns 66 may preferably form an integral part of top platform 32. Columns 66 are relatively wide at the bottom 90 and top 92 to provide stability for top platform 32 when mounted on bottom platform 30. The midsections 93 of columns 66 may preferably be indented to provide better access of food through passage 94 to bottom platform 30. As shown, columns 66 are curved to conform to the arcs of ledges 64.

Upper side 96 of top platform 32 is defined by a plurality of raised ribs 98 or fins which have particular advantage in supporting certain types of food without using a cooking utensil. More specifically, for example, upper side 96 functions as a roasting rack wherein grease drips from meat such as bacon down onto sloped ducts 100 to annular trough 102 where it collects. In other words, meat can cook or roast without sitting in its own grease drippings. Top platform 32 is made of a microwave transparent or low loss material. Because it may be exposed to hot grease, it should also be resistant to high temperature as is bottom platform 30.

As briefly described earlier herein, the rotation of the bottom platform shaft 38 is driven by motor 34 which is contained within motor housing 48. As is well known in the art, metal parts in close proximity to each other will arc in a microwave field. As it may be desirable to use metal parts for motor 34, it is preferable that motor housing 48 substantially shield motor 34 therein from microwave energy. Accordingly, motor housing 48 consists of metal pan 104 having flange 106 to which metal lid 46 is tightly riveted at a plurality of locations 108. Circular aperture 110 in lid 46 is of small enough circumference so as to be below cut off for the frequency of 2450 MHz. Because shaft 38 is made of a microwave transparent material, it does not act as a coaxial center conductor to couple microwave energy through aperture 110. In an alternate embodiment, motor 34 may be powered by batteries in which case a relatively long on/off switch arm (not shown) could extend through a small hole in the side of pan 104 to an accessible point in the proximity of handle 82. As described earlier, extension 44 of lid 46 is connected to base 54. Accordingly, motor housing 48 is suspended above the floor of the microwave cavity by a gap 112 so that air may pass through openings 60 underneath the motor housing for cooling. Also, gap 112 separates the metal motor housing from any floor surface to which it might arc.

Referring to FIG. 7, locations 108 of rivets around flange 106 of pan 104 to connect it to lid 46 may be spaced at more than the standard microwave environment rivet spacing of approximately one or two inches. This increased spacing can be used without arcing between the connected metal parts because annular inverted channel 114 provides a low microwave field region. More specifically, channel 144 has a width of approximately 0.5 inches defined by the outer wall of pan 104 and the surface of downward projection 150 of extension 44. The outer surface of groove 42 further limits the microwave field in channel 114.

Referring to FIGS. 7 and 8, a top and side sectioned views of pan 104 with motor 34 attached therein are shown. Motor 34 as described is not exposed to any microwave energy because it is shielded by motor housing 48. Motor 34 is shown as a wind-up type and is securely fastened to the inside bottom of pan 104. A metal socket 115 within shaft 38 engages drive sprocket 116. The bottom of sprocket 116 couples to gear 118 that engages gear 120 which is on the same shaft as gear 122 which is part of braking mechanism 124. The rest of conventional mechanism 124 includes a series of spaced parallel upright shafts 126, 128, and 130 having their ends rotatably connected in plates 132 and 134. Shafts 126 and 128 support pinioned gears 136 and 138. Shaft 130 supports star gear 140 and is mounted in slots 142 so that it can move tangentially to disengage from idler 144 when coil spring 146 is being wound. Energy is stored for operation in coil spring 146 by twisting bottom platform 30 with respect to base 54 to which motor housing 48 is attached. Coil spring 46 has one end secured to bracket 148 and the other end secured to sprocket 116. Gears 118 and 120 are used so that coil spring 146 and braking mechanism 124 can be mounted in substantially the same horizontal plane so that the profile of motor housing 48 can be minimized. In operation, energy stored in coil spring 146 turns sprocket 116 which in turn rotates shaft 38 and bottom platform 30. When top platform 32 is mounted on bottom platform 30, it also rotates. The speed of the rotation is limited by braking or timing mechanism 124 and its idler 144 as is conventionally done. As described earlier herein, the rotation can be prevented by sliding lock 76 being pulled to the outward position by handle 82 so that teeth 74 and engage teeth 86.

Turntable 10 provides substantial cooking flexibility. More specifically, bottom platform 30 has a relatively low profile and therefore can be used to rotate food or utensils having relatively large heights; obviously, the exact height of foods that can be cooked is also a function of the cavity height of the microwave oven. Also, top platform 32 can be mounted on top of bottom platform 30 so that two relatively low profile foods or utensils can be rotated simultaneously. Further, in addition to top platform 32 supporting cooking utensils, it will also function as a bacon or roasting rack. Furthermore, top platform 32 can be removed from bottom platform 30 and the roasting rack used as a stand alone unit; obviously, in this configuration, the top platform will not be rotated.

For various applications, it may be preferable that turntable 10 have particular dimensions. One set of dimensions that is well suited for most commercially available microwave ovens and utensils will be described. Both the top and bottom platforms are circular and have a diameter of approximately 12 inches. Ledges 64 are indented into bottom platform 30 and define opposite arcs of approximately six inches in circumferential inches. The midsection 93 of elongated columns 66 may be approximately three circumferential inches so as to provide sufficient access to bottom platform 30. Support surface 36 of bottom platform 30 is elevated less than 1.5 inches from the floor of the microwave cavity so as to provide a lower profile than prior art portable microwave oven turntables.

This concludes the Description of the Preferred Embodiment. Many alterations and modifications will become apparent to those skilled in the art without departing from the spirit and scope of the invention. Accordingly, it is intended that the scope of the invention be limited only by the appended claims.

What is claimed is:

1. A turntable adapted for being positioned in a microwave oven to provide substantially uniform food heating by rotation thereof, comprising:

a microwave transparent platform for supporting food, said platform having a shaft extending downwardly from the middle of the underside thereof;

means for rotating said platform about the axis of said shaft, said rotating means comprising a coil spring and a braking mechanism positioned in substantially the same horizontal plane thereby minimizing the vertical height of said rotating means;

means for shielding said rotating means from microwave energy, said shielding means comprising a metal pan having a metal cover with an aperture therein, said cover extending outwardly from the side wall of said pan to form a lip, said lip extending outwardly for a distance and then downwardly forming a channel to provide a low microwave field region between said side of said pan and the downward region of said lip, said lip further having an annular trough;

spherical bearings positioned in said trough;

an annular keeper positioned over said trough for maintaining substantially equal spacings between said bearings;

said platform being supported by said bearings; and said shaft extending through said aperture for coupling to said rotating means.

2. The turntable recited in claim 1 wherein said platform defines a substantially circular disk.

3. The turntable recited in claim 1 wherein said bearings and keeper comprise microwave transparent material.

4. The turntable recited in claim 1 further comprising a protrusion from the underside of said platform adjacent to said keeper for preventing said keeper from riding upwardly upwardly on said bearings.

5. The turntable recited in claim 1 wherein said distance is approximately 0.5 inches.

* * * * *